United States Patent [19]

Frech et al.

[11] 4,027,870

[45] June 7, 1977

[54] END FOR END DOCUMENT INVERTER

[75] Inventors: Roger Alvan Frech, Canoga Park; Martin Moses Bondar, Northridge, both of Calif.

[73] Assignee: Terminal Data Corporation, Woodland Hills, Calif.

[22] Filed: Oct. 4, 1976

[21] Appl. No.: 729,047

[52] U.S. Cl. ..... 271/65; 198/404; 271/186; 271/197; 355/23

[51] Int. Cl.[2] ..... B65H 29/00

[58] Field of Search ..... 271/65, 186, 197, 225, 271/DIG. 9; 198/404, 403; 355/23

[56] References Cited

UNITED STATES PATENTS

| | | | |
|---|---|---|---|
| 2,823,788 | 2/1958 | Chase | 271/225 X |
| 3,988,062 | 10/1976 | Burton et al. | 271/65 X |

*Primary Examiner*—Evon C. Blunk
*Assistant Examiner*—Bruce H. Stoner, Jr.
*Attorney, Agent, or Firm*—Harry R. Lubcke

[57] ABSTRACT

,1 A document moving apparatus having belt and pneumatic elements under electronic logic control to translate a document to a desired position, reverse translate it to a second position, turn it over, end-for-end, by motion at right angles to the direction of the prior translation while the document is adjacent to the second position, and thereafter to again translate the document to the desired position, inverted.

10 Claims, 4 Drawing Figures

REV. TACH.
FWD. CL.
REV. CL.
ON VAC.
OFF VAC.
MU-PL.
DRV.
FWD.
REV.
RESET
STATE
COUNTER
DRUM
RELAY
MN.TMR.
AU.TMR.
AUX. MEC. ST. TIMR.
ST. CTR.

END FOR END DOCUMENT INVERTER

BACKGROUND OF THE INVENTION

This invention pertains to precisely moving documents to desired positions.

Document handling apparatus is known in which plural slat-like fingers raise the document from a table and lay it down elsewhere upon the table.

Xerox printing on both sides of one web of paper has been proposed by running the web past printing cylinders disposed on opposite sides of the web.

BRIEF SUMMARY OF THE INVENTION

A typically two-sided document of which both sides are to be exhibited, is advanced planarly while flat by a first belt, which may use vacuum adhesion. The document progresses to exhibiting position, which may be for the purpose of photographing the document. It is stopped at the exhibiting position and whatever processing is to be carried out is accomplished while the document is stationary.

The direction of motion of the first belt is then reversed and the document is retracted from the exhibiting position to a second position.

An other belt is positioned over the first belt at this location.

By suitable logic control over pneumatic means associated with both belts the adhesion of the document to the first belt is terminated by stopping the vacuum thereat and acquisition of the document by the other belt is accomplished by starting the vacuum associated with that belt. The document is lifted a few millimeters to be in significant frictional contact with the other belt.

The other belt is oriented at a right angle with respect to the orientation of the first belt. Motion associated with the other belt accomplishes an end-for-end, or head-to-toe, inversion of the document; rather than a side-to-side inversion of the document, as is accomplished if the inversion means is colinear with the belt that gives the first motion. This presupposes that the document is disposed with its top to bottom dimension transverse of the motion of the first belt. This is the usual and desirable orientation of the document.

The other belt conveys the document away from the first belt and to a relatively large drum having a still other belt for urging the document around the drum. The drum is supported exclusively by the still other belt and a hinged arrangement of the belt allows the drum to be freed, should there be a malfunction.

Upon being thus inverted the document moves upwardly at an incline to the other belt in the direction toward the first belt. The direction of motion of the other belt has been reversed by the electronic logic by this time, and so from an inclined chute the document returns on the same underside of the other belt that took the document away from the first belt at the beginning of the turn-over sequence.

When the document has been returned to the second position the vacuum retention to the other belt is terminated and the vacuum adhesion to the first belt is restored.

Under further logic control the first belt again advances the document to the exhibiting position and stops it. The second side of the document is then processed while the document is stationary.

As a practical subsequent step the first belt is again translated farther forward, under the control of logic, to move the document beyond the exhibiting position to a discharge position to complete the whole cycle.

DESCRIPTION OF THE PREFERRED EMBODIMENTS

Figure 1:
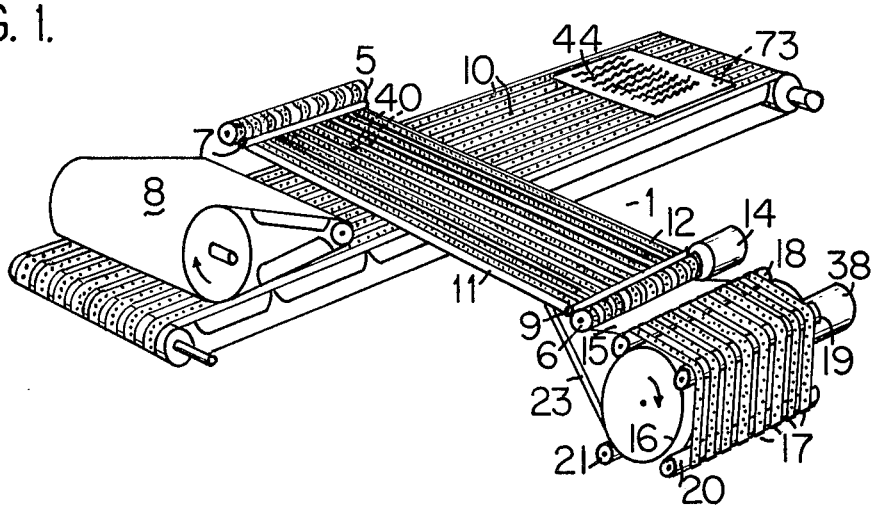
FIG. 1 is a perspective view of the end-for-end document inverter of this invention in combination with the basic machine in simplified form.

The structure of the basic-use machine, to which the present end-for-end document inverter is an attachment, was disclosed in the J. Burton et al U.S. patent application, Ser. No. 597,044, filed July 18, 1975, now U.S. Pat. No. 3,988,062, issued Oct. 26, 1976 which disclosure is herein specifically incorporated by reference.

Elements of that machine that are herein illustrated carry the same reference numerals as in that application.

The distinguishing characteristic of the present invention is that the document inverting mechanism is significantly at right angles to the general document path of the basic-use machine.

Figure 2:
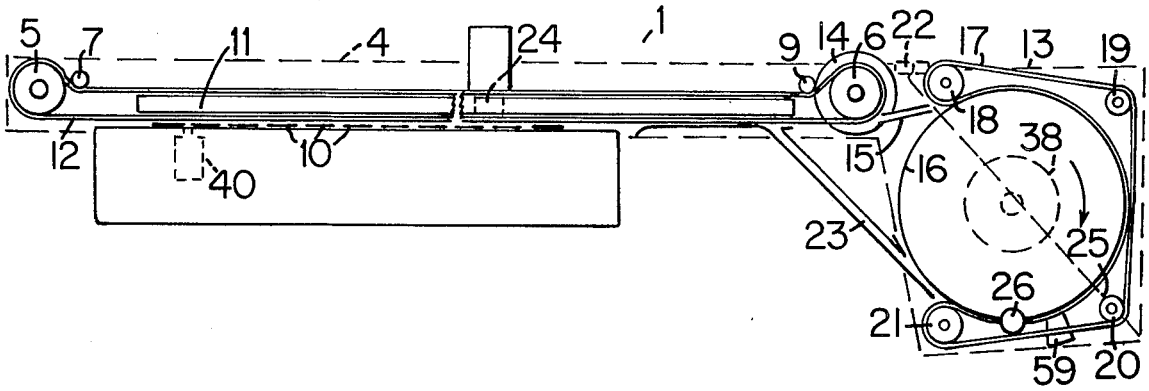
FIG. 2 is a side elevation view of mainly the inverter portion of the whole.

In FIGS. 1 and 2 the inverting mechanism of this invention is generally identified by reference numeral 1. A plurality of belts, 12, such as eight, is the means by which a document 44 is taken from a similar belt structure 10 of the basic-use machine for the purpose of inverting the document. Frame 4 of the inverting mechanism has a pair of rollers 5 and 6 between which belts 12 are stretched. Auxiliary rollers 7 and 9 are adjacent to rollers 5 and 6, respectively, to reduce the separation between the upper and lower courses that endless belts 12 occupy.

Frame 4 also supports plenum 11, which is disposed just slightly above the lower course of belt 12 and is provided with numerous small holes adjacent to that course. When a vacuum is created within the plenum a document is caused to adhere to the bottom of the lower course of belt 12. This takes place whether the belts are stationary or whether they are moving.

A source of vacuum and an electrically operated valve, both not shown, are pneumatically connected to plenum 11. The valve is connected by electronic logic control circuits, shown in FIG. 4, so that the vacuum will be impressed at the correct times during the conveyance of a document through the apparatus.

In a similar manner, the vacuum to the plenum ceases at correct times, such as when the document is to be discharged from the inverting part of the apparatus. Cessation of the vacuum in a plenum existing under main belts 10 allows the document to be raised the small distance, say 2 millimeters, between the top of belts 10 and the under side of belts 12. At other times, a vacuum existing under belts 10 causes the document to be moved and retained upon these belts in its travel through the basic-use machine.

Reversible motor 14 is connected to rotate roller 6, and through belts 12, also roller 5. It may be of the permanent magnet type, operable on d.c., with brushes, such as the Electrocraft torque motor. Under electronic logic control this motor translates belts 12 initially to the right and after the document has passed around the inverting drum 16 the motor translates belts 12 to the left, to return the document to the same position, but inverted, with respect to the basic-use machine belts 10.

The document is translated to the right on belts 12 with appreciable velocity, such as 2.5 meters per second. It is therefore automatically discharged into first guide 15. This guide is inclined slightly upward to direct the document between drum 16 and belts 17, which belts surround a major portion of its periphery. The document is returned to the belts 12 through inclined second guide 23.

Drum 16 floats within the enclosing configuration of belts 17; that is, the drum has no shaft nor journals. Belts 17 are endless and are supported by a plurality of rollers, such as four; i.e., 18, 19, 20, 21. Roller 21 is journaled in frame 4, and the other three are journaled in frame 13, to be later described.

Belts 17 are preferably composed of six narrow belts, each having a width of the order of 14 mm. with a spacing between belts of 25 mm. Rollers 18 and 21 are preferably of uniform diameter throughout the length of each and do not provide lateral constraint for the several belts 17. Rollers 19 and 20, on the other hand, are composed of six individual crowned rollers that are spaced in position, one from the other, by spacers along a common shaft.

Figure 3:
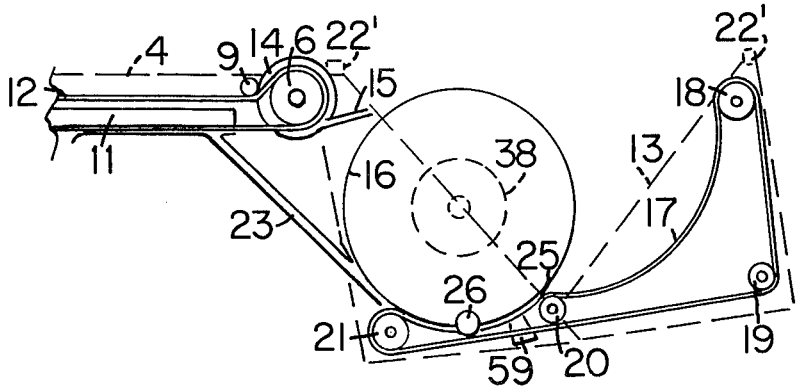
FIG. 3 is a fragmentary side elevation view showing the open position of the inverting drum assembly of the inverter of FIG. 2.

In order to allow removal of a possible jammed document upon drum 16, or for service reasons, the still other belt 17 assembly is provided with a pivot at roller 20. Rollers 18, 19, 20 are supported by a two-sided frame 13 that hinges at the shaft of roller 20. Roller 21 is supported by frame 4. In FIGS. 2 and 3 both frames 4 and 13 are shown in dotted phantom to more clearly reveal the significant roller, belts and drum mechanism. The pivot is hinge 25, FIG. 2.

Catches 22 at each end of roller 18 fasten belts 17 and that assembly in place for normal use by connecting frame 13 to frame 4. When the catches are unlatched the assembly folds away from drum 16 and allows at least a 180° access thereto. If desired, drum 16 can then be removed. The separated catches are 22' in FIG. 3.

Drum 16 is laterally retained within frame 4 by guide button 26, there being one on each side that peripherally engages the drum. The buttons may be fabricated of the polytetrafluoroethylene resin obtainable commercially as Teflon, by DuPont. This material is suitable because of its self-lubricating properties. The buttons are typically threaded in frame 4 to allow lateral adjustment with respect to the drum.

In turning now to the electronic logic control circuits for actuating the mechanical elements for turning the document over, end-for-end, reference is again made to the prior patent application, Ser. No. 597,044, filed July 18, 1975, now U.S. Pat. No. 3,988,062, particularly to FIGS. 7 and 8 thereof.

State counter means 30 comprises the major logic-program controller for the present mechanical assembly. This is in FIG. 4, herein. It has the same circuitry as prior state counter 130 in the prior FIG. 7 above referred-to. It has an internal state counter 131, such as a type 74163 integrated circuit (IC), a data multiplexer 132, such as a 74151, and a decoder 133, such as a 7442. These elements are connected by an equivalent single connection, save the decoder, which accepts inputs from both the counter and the multiplexer.

Figure 4:
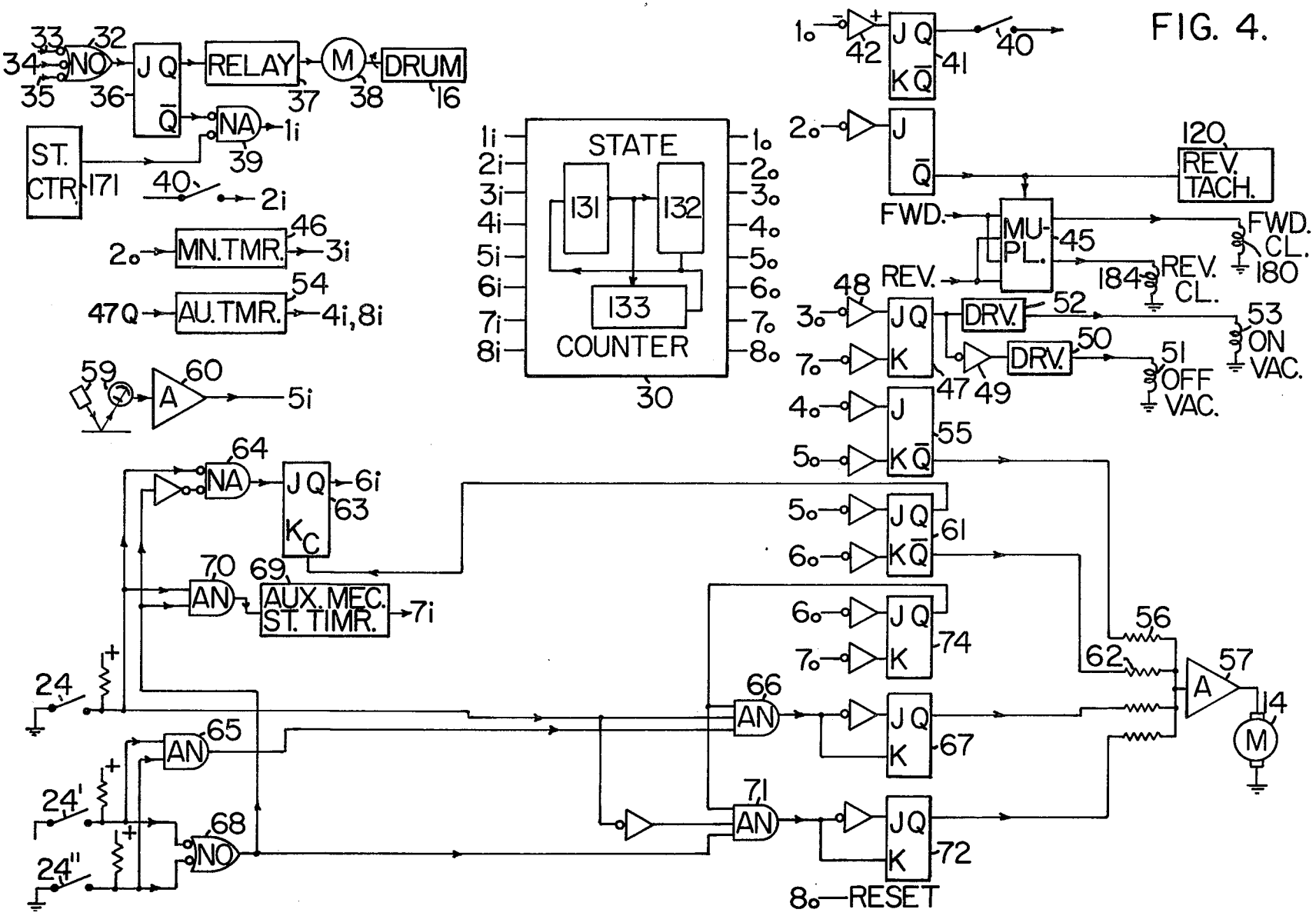
FIG. 4 is a diagram of the electronic logic circuits that are coactive particularly with the inverter portion of the apparatus.

Further referring to FIG. 4, negative OR gate 32 is provided to accept any of three inputs that will cause the present apparatus to function.

Input 33 may be an electrical command from a coordinating computer.

Input 34 may be from a manual control, such as the electrical voltage from the circuit of a foot switch.

Input 35 may be from the response to a control document.

A control document is useable on the document handling machine of this invention. It is described in a patent to Burton and Whitney entitled "Controlled Document Recording System", a U.S. Pat. Office Published Patent Application, No. B 430,140, dated Jan. 28, 1975, now U.S. Pat. No. 3,922,084. These specially prepared documents affect sensors on the main machine which initiate selected functions, such as turning the succeeding document over, end-for-end, in the present instance.

When a valid input is received by gate 32 an output therefrom enters the J input of J-K flip-flop 36, which acts as a latch. The Q output therefrom passes to relay 37, which has a nominal powerhandling characteristic and may be of the solid-state type, and thence to motor 38. This motor drives drum 16 and may be of the alternating current type having phase control for altering the speed of revolution.

Simultaneously with the above functioning, one input of negative AND gate 39 is fed from the $\overline{Q}$ output of flip-flop 36. The second input of gate 39 is from the state counter that is in the basic machine that executes the command that was previously provided-for in the basic program, or otherwise, ordering that the second side of a two-sided document shall be microfilmed by the basic machine. When the turn over is to be head-to-toe (end-for-end), the apparatus of the present invention is put into action.

When both of these inputs are presented an output occurs from gate 39. This has been labeled "1i" in FIG. 4. The numeral 1 signifies a first quantity and the letter *i* signifies an input. Both refer to state counter 30 of this invention. As such, it starts the operation of that counter and thus the functioning according to the present invention.

The first output of state counter 30 is labeled "1*o*". This output occurs as soon as the 1*i* input is received. This output prepares document-discerning vacuum switches that are represented by switch 40. This is brought about by the Q output of J-K flip-flop 41, which flip-flop is fed from inverting amplifier 42, which amplifier receives the 1*o* output from the state counter.

Switch 40 represents a pair of vacuum switches that are positioned on the main table and act by vacuum through belts 10. The switches are located at the edge of the table and directly under cross belts 12 so that vacuum manipulation can transfer document 44 as it returns from the photographing station. Switch 40 is shown in FIG. 1 and in FIG. 2, being dotted in both figures.

When the document covers switches 40 input 2*i* to state counter 30 triggers the output 2*o* thereof. This, in turn, activates multiplexer 45, which reverses the sense of forward clutch 180, reverse clutch 184, ad tachometer 120 of the basic machine, FIGS. 7 and 8, of the patent application previously referred to.

When the program calls for turning the document over, end-for-end according to this invention, the document stops at a location centered under belts 12. An interval of time for the document, and main belts 10, to come accurately to rest is provided by the functioning of main table stabilization timer 46. This timer is started by the document covering switches 40. The interval of time is provided by counting and an output pulse at the end of the count. A type 74163 IC, having a synchronous binary counter with a clock circuit is suitable.

The end output pulse enters state counter 30 at 3*i*. This triggers output 3*o*. This output enters the J input of J-K flip-flop 47 after passing through inverting amplifier 48. The Q output of flip-flop 47 passes through another inverting amplifier 49 and driver 50 that energizes the main table solenoid valve 51. In this instance the valve is deenergized, removing the vacuum from the main table belts 10.

The same Q output from flip-flop 47 passes directly through another driver 52 and energizes the auxiliary table vacuum solenoid 53. This provides vacuum thereon. The auxiliary table vacuum stabilization timer 54 is also started. The vacuum on the auxiliary table and the cessation of vacuum on the main table results in the document being pulled upward to the auxiliary table and belts 12, where these overlay the main table, as can be seen in FIG. 2.

Upon the completion of the time interval provided by stablization timer 54 the input 4*i* to state counter 30 is activated. This triggers 4*o*, which commands auxiliary table d.c. servo motor 14 to move belts 12 of that table at a "fast forward" speed. This takes place through the J input and the $\overline{Q}$ output of J-K flip-flop 55, summing resistor 56, servo amplifier 57, and to motor 14.

The document is transferred from belt 12 to drum 16 during this fast forward travel. When the document rotates around the drum it is turned over.

Reflective light photosensor 59, which may be an electro-optical type, having light-emitting diode illumination and photo-transistor sensor, is positioned at about three-fourths of the travel of the document around the drum. The location is shown in FIG. 2.

Electrically, the output from photosensor 59 passes through amplifier 60 and then enters input 5*i* of state counter 30. The resulting 5*o* output enters the K input of J-K flip-flop 55, reversing the state of that flip-flop set by the prior J input, and so the prior fast forward energization of servo motor 14 ceases.

Through the J input to flip-flop 61 the same 5*o* output causes the $\overline{Q}$ output of that flip-flop to act through summing resistor 62 to energize servo motor 14 through amplifier 57 to operate in the fast reverse direction. This opposite functioning to what was previously accomplished is brought about by reversing the voltage polarity to servo motor 14 by a level-shifted reversed voltage on the input to amplifier 57.

The Q output of flip-flop 61 is connected to the C, clear, terminal of flip-flop 63, enabling the same for a function to be subsequently described.

Since belts 12 have now been reversed in the direction of travel, when the document passes beyond drum 16 and through slot 23, which is inclined, it will be carried back to the original position over belts 10.

In this position the document will close vacuum-operated switch 24. This switch is located upon the structure of this invention, with vacuum ports positioned adjacent to belts 12. See FIG. 2. This switch is ANDed with companion switches 24′ or 24″, through negative AND gate 64.

The output of this gate is connected to the J input of J-K flip-flop 63. An electrical response to the latter activates state counter 30 at input 6*i*. The resulting output 6*o* is connected to the K input of flip-flop 6*l*, and an electrical response to the latter results in the fast reverse mode of belts 12 motion being stopped. This also results in energizing the J input to J-K flip-flop 74, and allows a fast forward energization for a short period of time to accomplish braking of the belts. The Q output of flip-flop 74 also gates the slow speed functions of J-K flip-flops 67 and 72.

Companion switches 24′ and 24″ act to bring the document to rest at a precisely predetermined location that depends upon the placement of these vacuum switches with respect to the translation effected by belts 12. The manner in which the switches achieve precise positioning despite the dynamic inertia of belts 12, rollers 5 and 6, and the rotor of motor 14 is set forth below.

The document always overshoots the final position in the normal functioning of belts 12 according to this invention. In so doing it opens all of the three vacuum-operated switches 24, 24′ and 24″. These switches are mounted close together in a triangular configuration.

When the three switches are opened AND gate 65, connected to both switches 24′ and 24″, is also opened. Along with open switch 24 these all open three-input AND gate 66. The output of gate 66 enters the J input of flip-flop 67 through an inverting amplifier and also directly to the K input. The Q output of the flip-flop passes through a summing resistor and amplifier 57 to cause servo motor 14 to go slowly forward.

When the document has moved slightly forward and reaches the position where vacuum switch 24 is open and where either vacuum switch 24′ or 24″ are closed, through negative OR gate 68 the auxiliary table mechanical stabilization timer 69 is activated through AND gate 70. The latter does AND switch 24 open and switch 24′ or 24″ closed.

If, for any reason, all of the three switches close again, a slow reverse command to servo motor 14 is activated through three-input AND gate 71. The latter acts through flip-flop 72 and auxiliaries in the same manner as did AND gate 66 and flip-flop 67 as previously described.

State counter 30 inputs 6*i* and 7*i* and outputs 6*o* and 7*o* coact with J-K flip-flop 74. The Q output thereof enters as one of the inputs to AND gates 66 and 71. With other inputs to AND gates 66 and 71 present a slow forward or slow reverse actuation of motor 14 takes place through flip-flops 67 or 72, respectively.

This structure acts to position the document accurately and speedily. The document arrives at its final return position at a fast reverse speed. It overshoots switches 24. Braking is applied by reversing the direction at a fast forward speed for a short period of time and then a slow forward speed is instituted until the document attains a final accurate position. Should the document overshoot its final position, a slow reverse speed is applied to drive it to its final position.

When timer 69 has completed its time interval via 7*i* to 7*o*, all of the commands to servo motor 14 are reset. Also, auxiliary vacuum solenoid 53 is turned off. This turns off the auxiliary vacuum. The main table vacuum through vacuum solenoid 51 is turned on. The auxiliary table stabilization timer 54 is started.

The document starts dropping to belts 10 of the main table. After timer 54 has completed its time interval it triggers 8*i*. This activates 8*o* and that resets all of the auxiliary end-for-end document inverter circuitry.

Control is also returned to state counter 171 of the main machine, as shown in FIG. 8 of the incorporated patent. This allows the document to again return to the photographing position for photographing the second side. The photographing position is where document 44 is shown in FIG. 1 of this invention. In order for the document to arrive there from belts 12 to belts 10 the latter main table belts need only to transport it to the right and stabilize it at the photographing position.

Subsequent to this second photographing, further apparatus and control on the main machine causes the document to progress farther to the right in FIG. 1 and be physically discharged from the main machine.

It will be recognized that the side-for-side document inverter of the basic machine described in the above referred to patent application may also be physically present and alternately employed when the end-for-end document inverter of this invention is present and employed.

The two inverters are disposed at different locations along main belts 10, the side-for-side being labeled 8 in FIG. 1.

For clarity of nomenclature main belts 10 are identified as "first belts," and belts 8 of the side-for-side document inverter are identified as "second belts."

For the end-for-end document inverter of this invention, belts 12 are identified as "other belts", and belts 17 as "still other belts."

Similarly, the end-for-end document inverter control means 30 is identified as "other control means."

Herein sensors are employed to sense the presence of a document at the sensor position. These may be of more than one type, depending upon the availability of the document for sensing. Sensor 40 is a vacuum operated switch. Another sensor 24 is also a vacuum operated switch. Still another sensor 59, sensing a document upon drum 16, is a light reflective photo-sensitive device.

We claim:

1. The method of moving a document for stationarily exhibiting both sides thereof, which includes, in order, the method steps of;

a. planarly translating said document, while flat, forward over a path to an exhibiting position, and stopping it, b. planarly translating said document, while flat, backward from said exhibiting position over substantially the same said path and again stopping it, c. planarly translating said document, while flat, at right angles to said path, d. curvilinearly turning said document while it is still moving at right angles to said path, e. planarly returning said document, while flat, to the previously again-stopped position, and f. again planarly translating said document, while flat, forward over said path to the exhibiting position, and stopping the document for the second time at the exhibiting position.

2. The method of claim 1, which includes the additional step of;

a. further planarly translating said document, while flat, farther forward from the second stopping at said exhibiting position to terminate the motion of said document.

3. A document moving apparatus comprising;

a. first belt means (10) to reversibly translate a document, b. first control means to stop said first belt means for a predetermined interval of time at a first position and thereafter to reverse the direction of motion of said first belt means and to stop the same at a second position, c. other belt means (12) disposed above said first belt means at said second position and oriented to move said document (44) at right angles to the previous direction of translation of said document, d. a drum (16), e. still other belt means (17) substantially surrounding and acting to support said drum, to accept said document from said other belt means and to return it inverted to said other belt means, f. pneumatic means adjacent to and coactive with both said first and said other belt means, to attach said document to either of said belt means and g. other control means (30,-72) coactive with said first and said other belt means and with said pneumatic means to sequentially;

1. release said document from said first belt means,

2. attach said document to said other belt means (12) for turning the document over,

3. release said document from said other belt means, and

4. again attach said document to said first belt means in an end-for-end inverted relation with respect to the first attachment of said document to said first belt means.

4. The apparatus of claim 3, which additionally includes;

a. a first guide (15) disposed between said other (12) and said still other belt means(17)

to guide a document to said still other belt means, and b. a second guide (23) disposed adjacent to said still other belt means oppositely from said first guide and inclined to said other belt means to guide said document back to said other belt means in inverted orientation.

5. The apparatus of claim 3, in which said first belt means (10) additionally includes;

a. a sensor (40) disposed adjacent to said first belt means at the intersection of said belt means (12) therewith, to sense the presence of a document upon said first belt means at said intersection.

6. The apparatus of claim 3, in which said other belt means (12) additionally includes;

a. an other sensor (24) disposed adjacent to said other belt means away from said first belt means (10)

to sense the presence of a document upon said other belt means.

7. The apparatus of claim 3, which additionally includes;

a. a hinge (25) related to said still other belt means (17) to allow said still other belt means to be moved away from said drum (16), and b. a catch (22) disposed oppositely away from said hinge to selectively prevent the movement of said still other belt means from said drum.

8. The apparatus of claim 3, which additionally includes;

a. a guide button (26) peripherally located with respect to said drum (16) end, said button longitudinally adjustably disposed in relation to said still other belt means (17) to axially position said drum with respect to said still other belt means.

9. The apparatus of claim 3, in which said other control means includes;

a. state counter means (30) responsive to a sensor (40), to another sensor (24), and to still another sensor (59), for the control of said state counter means according to the position of said document (44), b. plural stabilization timers (46, 54, 69) connected to said state counter means, c. plural logic means (32-63) to enter electrically represented data from said sensors and from said timers for activating said state counter means, and d. plural output logic means (42-74) connected to said state counter means and to electromechanical elements for the manipulation of said document by said document moving apparatus.

10. The apparatus of claim 9, in which said still another sensor (59) includes;

a. a light sensor (59) disposed peripherally of said drum (16) to sense a document upon said drum, and b. a connection (5i) from said light sensor to said state counter means (30), to actuate said state counter means to reverse the direction of translation of said belt means (12)

to thereby carry said document from said drum back to said first belt means (10).

* * * * *